US005079531A

United States Patent [19]

Audoux et al.

[11] Patent Number: 5,079,531

[45] Date of Patent: Jan. 7, 1992

[54] GEOMETRY CORRECTION DEVICE FOR CATHODE RAY TUBES

[75] Inventors: Eric Audoux, Aiserey; Jean-Pierre Fourche, Dijon; Jean Rousseau, Villers-Rotin, all of France

[73] Assignee: Videocolor S.A., Courbevoie, France

[21] Appl. No.: 579,515

[22] Filed: Sep. 10, 1990

[30] Foreign Application Priority Data

Sep. 12, 1989 [FR] France ..... 89 11893

[51] Int. Cl.[5] ..... H01F 3/12

[52] U.S. Cl. ..... 335/211; 335/210; 313/426

[58] Field of Search ..... 335/210, 211, 212, 214; 313/426, 427

[56] References Cited

U.S. PATENT DOCUMENTS 4,257,023 3/1981 Kamijo ..... 335/210 X
4,307,363 12/1981 McGlashan .
4,429,293 1/1984 McGlashan .
4,746,837 5/1988 Vink ..... 335/213 X

FOREIGN PATENT DOCUMENTS 228744 7/1987 European Pat. Off. .
57-3353 1/1982 Japan ..... 335/213
57-38545 3/1982 Japan ..... 335/213
2083689A 3/1982 United Kingdom .
2140200A 11/1984 United Kingdom .

*Primary Examiner*—George Harris
*Attorney, Agent, or Firm*—Joseph S. Tripoli; Joseph J. Laks

[57] ABSTRACT

A deflection yoke arrangement with geometry correction includes horizontal and vertical deflection coils for scanning a raster pattern on a phosphor screen of a cathode ray tube. A support housing suitable for positioning about the neck of the cathode ray tube contains the coils and has a front rim formed with a plurality of slots near the outer periphery. A plurality of brackets formed from magnetically permeable material are located in corresponding ones of the slots. Each bracket comprises two flat end sections joined to opposite sides of a flat central part at substantially right angles thereto. One of the flat end sections of each bracket collects magnetic flux generated by the coils and channels the flux via the central part to the other end section. The plurality of brackets shape the deflection magnetic field in the region about the front rim to provide the geometry correction.

6 Claims, 2 Drawing Sheets

FIG. 1
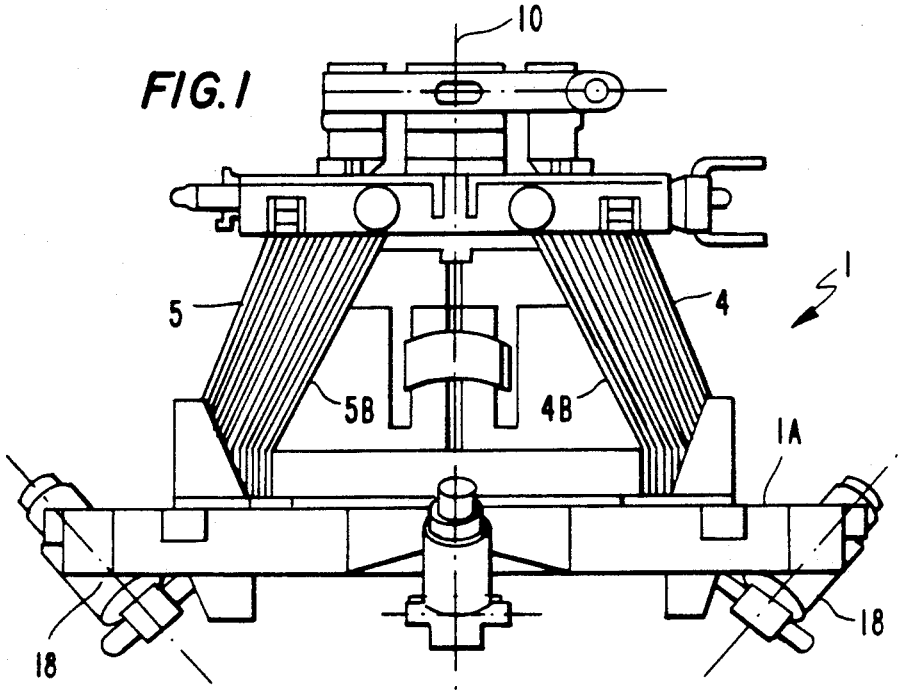
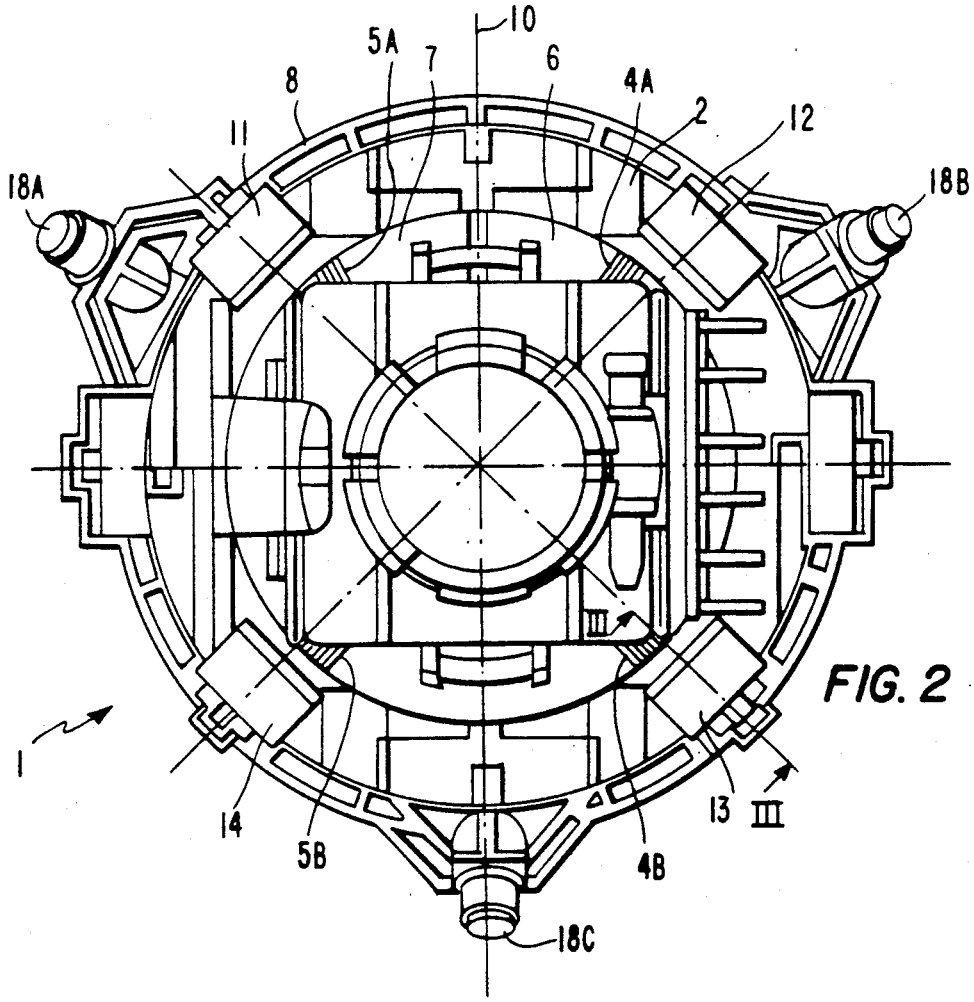
FIG. 2

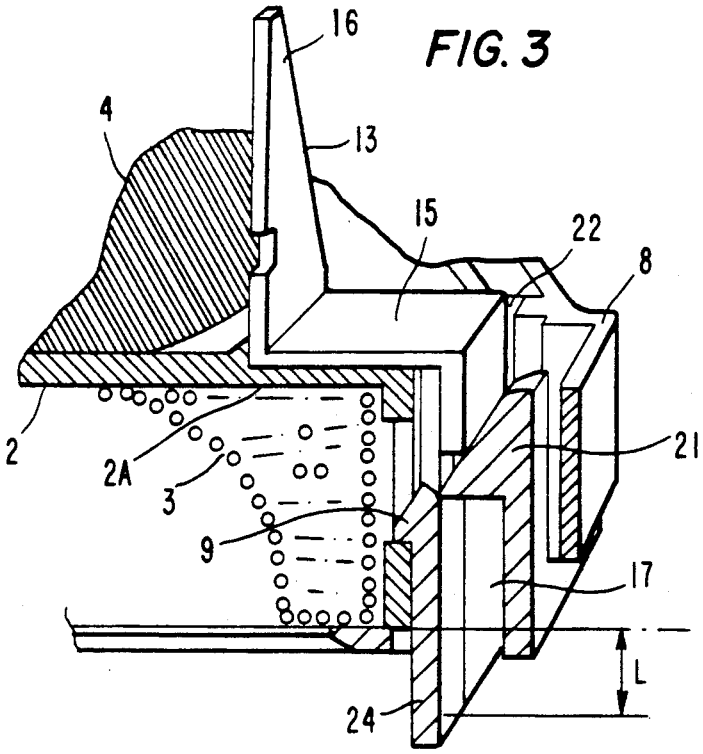
FIG. 3
FIG. 4
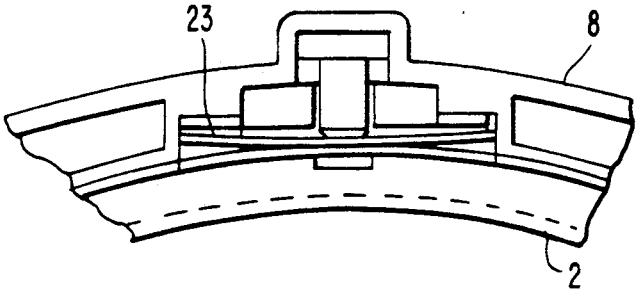
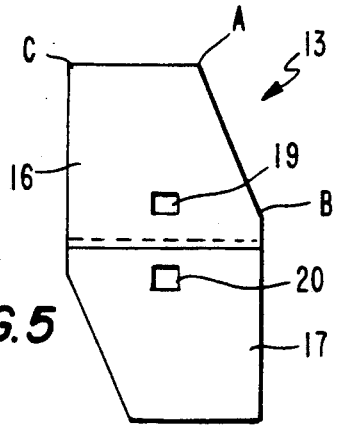
FIG. 5
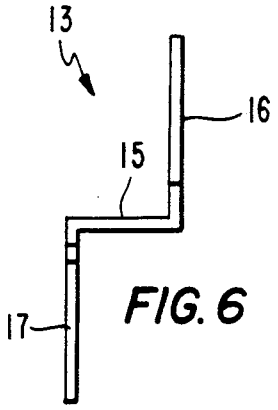
FIG. 6

GEOMETRY CORRECTION DEVICE FOR CATHODE RAY TUBES

The present invention relates to a geometry correction device for cathode ray tubes.

In a trichromatic cathode ray tube, of the self-converging type with a saddle-torus type deflection yoke, the image formed on the screen presents "pincushion" distortion because of the difference between the length of the radius of curvature of the screen and the distance from the center of deflection and the screen.

These geometric errors can be corrected with the aid of electronic circuits, but such circuits are complex and costly.

Another solution, described in British Patent 2,010,005, of Toshiba, corresponding to U.S. Pat. No. 4257023, issued Mar. 17, 1981, to Kamijo equips the deflection yoke with cross arms of magnetically permeable material, which pick up the leakage field of the vertical deflection torus coil and produce a correction field at the exit end of the deflection yoke. According to an embodiment described by Toshiba, the correction is obtained with the aid of two generally U-shaped pieces of magnetically permeable material of large dimensions, with curved surfaces. Such parts with complex surfaces are difficult and costly to manufacture, and their positioning is not easy to automate.

According to a second embodiment in the Toshiba patent, the correction is obtained by means of four relatively simple pieces in the form of rectangular tabs. The front portions of these correction pieces producing this correction field must be and remain precisely oriented during the subsequent stages of manufacture and handling of the deflection yoke. These known tabs are long and flexible and often are at risk of being deformed. Besides, the precise positioning and fixing of these pieces is not easy to automate, because, before their final fixing by gluing, they are simply held at the periphery of a thin rim by two small clips on this rim.

The present invention provides a device for correcting geometric errors of the aforesaid type which is simple and inexpensive to make, the positioning of which is easy to automate, and whose orientation is not at risk of being changed during subsequent stages of manipulation.

A deflection yoke arrangement with geometry correction includes horizontal and vertical deflection coils for scanning a raster pattern on a phosphor screen of a cathode ray tube. A support housing suitable for positioning about the neck of the cathode ray tube contains the coils and has a front rim formed with a plurality of slots near the outer periphery. A plurality of brackets formed from magnetically permeable material are located in corresponding ones of the slots. Each bracket comprises two flat end sections joined to opposite sides of a flat central part at substantially right angles thereto. One of the flat end sections of each bracket collects magnetic flux generated by the coils and channels the flux via the central part to the other end section. The plurality of brackets shape the deflection magnetic field in the region about the front rim to provide the geometry correction.

FIGS. 1 and 2 are, respectively, a side view and a view from behind of a deflection yoke equipped with a device according to the invention;

FIG. 3 is a view partially in section along line III—III of FIG. 2;

FIG. 4 is a view from above of a holding slot for a correction bracket of the deflection yoke of FIG. 1, and FIGS. 5 and 6 are, respectively, a front view and a side view of one of the four brackets of the correction device of the invention.

A deflection yoke 1, as shown in the various FIGURES, includes a horizontal deflection coil 3 of the saddle type, and two vertical deflection torus coils 4, 5, each wound on a magnetic half-core of ferrite 6, 7 respectively. The magnetic circuit formed by the two half-cores 6 and 7 has substantially the form of a conical ring. The line of the plane of symmetry of the vertical deflection coil is labeled 10 (FIGS. 1 and 2). A plastic ring 8 of substantially L-shaped cross section is fastened by several clips on the front end face of a separator 2 (clip 9 visible in FIG. 3). Separator 2 forms a support for horizontal deflection coil 3 and is made of a plastic material.

The correction device embodying an inventive feature is formed by four identical z-shaped shunts, hereafter called brackets. The brackets 11 to 14 are fastened on the anterior rim 1A of the deflection yoke 1. These brackets 11 to 14 are of rigid, high-permeability magnetic material, for example a sheet of soft silicon iron, preferably galvanized for anti-corrosion protection, of a thickness of about 0.5 mm.

The end turns of the vertical deflection coils 4, 5 are referenced 4A, 4B and 5A, 5B, respectively. The brackets 11 to 14 are fastened at the periphery of the separator 2, near the ends of the coils 4 and 5, preferably opposite the end turns 4A, 4B, 5A,m 5B of these coils (only a portion of these end turns is visible in FIG. 1).

In FIGS. 5 and 6 is shown one of the brackets of the correction device, namely bracket 13. Bracket 13, made of one piece, has three flat portions. The central part 15 is rectangular. In the embodiment shown, this rectangle has a length of 16 mm and a width of 10 mm. The central part 15 is connected by two of its opposite sides to two end portions 16, 17, each perpendicular to portion 15 and extending on either side of the plane of this portion 15. Bracket 13 is thus counter-elbowed (in the form of staircase steps). The portions 16, 17 both have the same form and dimensions and are symmetrical to the center of portion 15. These portions 16, 17 have a substantially square form.

However, in the embodiment shown, to leave a sufficient opening for the passage of two of the three screws 18A to 18C for position adjustment of the deflection yoke on the neck of the cathode ray tube, (passage of the screws 18A and 18B, FIG. 1), one of the corners of these portions 16, 17 is beveled. In the embodiment shown, the portions 16, 17 are inscribed in a square having sides about 16 mm long. The beveling consists in triangularly cutting one end corner of the portions 16, 17. According to the embodiment, for the portion 16, the cutting line joins points A and B, the summit of the end corner left intact being referenced C. A is about 11 mm from C, and B is about 2 mm from portion 15. Naturally, the beveling of portion 17 is symmetrical to that of portion 16 relative to the center of portion 15. To ensure the fixation of bracket 13, a hole 19, 20 is cut in each of its portions 16 and 17, and a snap-in hook 21 (see FIG. 3) forming part of the ring 8 engages in said hole.

The holes 19, 20 are also symmetrical to the center of portion 15. Their dimensions and locations are determined by the characteristics of hook 21, taking into account that the fastening device of bracket 13 must be solid, compact and simple. Preferably, the bracket must be able to disengage easily and readily after having been fixed in place. In the embodiment shown, the holes 19 and 20 are squares with a side length of about 3.5 mm, and their centers are about 3.5 mm from portion 15, and in the center of the width of portions 16 and 17.

The portions 16 and 17 of bracket 13 present a symmetry to the center of portion 15 in order to permit the insertion thereof in the support 2 of the deflection yoke 1 when indiscriminately introducing part 16 or part 17, which simplifies the automated assembly thereof.

The dimensions of parts 16 and 17 are determined taking into account the following requirements. The front ends of the brackets 11 to 14, extending beyond the end turns of the horizontal deflection coils and creating the magnetic flux of correction, must be rather long to produce a sufficient flux, but must not be long enough to become fragile and knock against the cathode ray tube to hinder the position adjustment of the deflection yoke relative to the cathode ray tube. It has thus been determined that the length L (see FIG. 3) of the ends of the portions 17 (or 16 if it has been introduced in the support) extending beyond the end turns of horizontal deflection coils 3 must not be less than about 3 mm. Preferably this length L is about 5 to 6 mm. On the other hand, the rear portion of the bracket 11 (the one directed toward the gun of the cathode tube; in the case of FIG. 3 that is portion 16) must be long enough to be able to pick up the leakage flux of vertical deflection coils 4 and 5. This length must be at least about 5 to 6 mm. Because the brackets are symmetrical to their center, the lengths of portions 16 and 17 must be equal. The aforesaid length of about 16 mm, for the embodiment represented, permits taking the above stated requirements into account. Said requirements of pickup of leakage flux of vertical deflection coils 4 and 5, and of sufficient emission of flux toward the front of the deflection yoke also enter in the determination of the width of the brackets 11 to 14. In the embodiment represented, in view of the beveling of the corners of these brackets, the aforesaid typical values (width of about 16 mm at part 15 and about 11 mm between A and C) give good results of correction.

To ensure the fastening of the brackets 11 to 14 on the support of the deflection, four slots are cut near the F periphery of its front rim 2A, opposite the four corners of the cathode ray tube on which the deflection yoke is to be installed and facing the end turns of the vertical deflection coils 4 and 5.

In FIG. 3, the slot is marked 22. In their central part, these slots are enlarged toward the peripheral flange of the separator, in order to arrange a passage for the snap-in hooks 21 formed on ring 8. It is, of course, not absolutely necessary to form the snap-in hook on ring 8. This hook could be formed on the separator 2, modifying, if necessary, the position of the holes 19, 20. Because of the presence of positioning screws 18A and 18B very close to same of the brackets (11 and 12, FIG. 1), all brackets have, as stated above, bevels. Consequently the brackets cannot be arranged in the same manner relative to these screws 18A to 18C. Looking at at brackets 11 and 12 successively, clockwise, it is noted that bracket 11 is situated after the adjacent screw 18B, while bracket 12 is situated before the adjacent screw 18B. The bevels of these brackets 11 and 12 must be on the side of the screws 18A, 18B, and consequently these brackets 11 and 12 are arranged symmetrically to the junction plane (10) of the two half-cores 6, 7. For reasons of magnetic symmetry of the deflection yoke, the brackets 13 and 14 are also arranged symmetrically to this junction plane.

Such an alternate arrangement of the brackets 11 to 14 can easily be made with an automatic machine. However, to avoid any incorrect placement of the brackets, even though this would be quite unlikely, the slots of these brackets are equipped with a very simple foolproof device. In the base of each slot, on the side where the respective bevel is to be located, a recess is formed; in FIG. 4, this recess is marked 23. It extends from the end of the respective slot to said bevel, over a length sufficient to prevent incorrect introduction of the bracket, without hindering its correct introduction. In the present case, this length is about 3 mm.

The brackets 11 to 14, made as stated above (sheet-metal 0.5 mm thick), are rigid. To reinforce this rigidity, ring 8 includes buttresses 24 (FIG. 3) which protect the fore portions (portion 17 in FIG. 3) of these brackets from bending, because the orientation of the front portions of the brackets is more critical than that of their rear portions. The buttresses 24 are partitions of sufficient thickness (for example 1 mm) extending in contact with the portions 17. The length (in axial direction) of the buttresses 24 is substantially equal to the length of the portions 17 extending beyond the front face of the deflection yoke, and their width is substantially equal to the width of the portions 17. The buttresses 24 are formed, in the embodiment, on ring 8, which serves essentially to support adjusting devices 18A to 18C; but of course, if the separator 2 of the deflection yoke 1 does not have such a ring 8 or is made differently, the buttresses may be formed on the separator itself.

If it is desired to reinforce also the rear portion of the brackets (portion 16 in FIG. 3), and to the extent that sufficient space remains between vertical deflection coils 4 and 5 and this rear portion, it is possible also to form buttresses for this rear portion.

It is understood that there may be combined with the device of the invention other known devices for correcting image geometry such as permanent magnets, and/or the vertical deflection coil may be wound in a non-radial manner.

What is claimed is:

1. A deflection yoke arrangement with geometry correction, comprising:

horizontal and vertical deflection coils for scanning a raster pattern on a phosphor screen of a cathode ray tube;

a support housing suitable for positioning about the neck of said cathode ray tube and containing said coils therein, characterized in that said housing has a front rim formed with a plurality of slots near the outer periphery thereof; and a plurality of brackets formed from magnetically permeable material, each bracket being located in a corresponding one of said slots, each bracket comprising two flat end sections joined to opposite sides of a flat central part at substantially right angles thereto, one of the flat end sections of each bracket collecting magnetic flux generated by said coils and channeling said flux via said central part to the other end section, the plurality of brackets shaping the deflection magnetic field in the region about said front rim in a manner that provides said geometry correction.

2. An arrangement according to claim 1 wherein the shape of each bracket is symmetrical about the central part of the bracket.

3. An arrangement according to claim 2 wherein the front rim of the support housing includes on the screen side a plurality of buttresses, each buttress being located next to a corresponding bracket for reinforcement of the screen side end section of that bracket.

4. An arrangement according to claim 1 wherein the front rim of said housing adjacent each slot includes means for providing a snap fit of the corresponding bracket into that slot.

5. An arrangement according to claim 4 including a quantity of glue holding in each place each bracket in its corresponding slot.

6. An arrangement according to claim 4 wherein said means for providing a snap fit comprises a hook which mates with a hole in said bracket.

* * * * *